US006410215B1

(12) United States Patent
Cole

(10) Patent No.: US 6,410,215 B1
(45) Date of Patent: Jun. 25, 2002

(54) HIGH TEMPERATURE COLOR DEVELOPMENT OF PHOTOGRAPHIC SILVER BROMOIODIDE COLOR NEGATIVE FILMS USING PH STABILIZED COLOR DEVELOPER

(75) Inventor: David Leroy Cole, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/708,163

(22) Filed: Aug. 27, 1996

(51) Int. Cl.[7] ..... G03C 7/407; G03C 7/413
(52) U.S. Cl. ..... 430/374; 430/490; 430/492
(58) Field of Search ..... 430/484, 489, 430/490, 374, 492

(56) References Cited

U.S. PATENT DOCUMENTS

| | | | | | |
|---|---|---|---|---|---|
| 4,814,260 | A | | 3/1989 | Koboshi et al. | 430/464 |
| 4,833,068 | A | | 5/1989 | Ohki et al. | 430/484 |
| 4,851,325 | A | * | 7/1989 | Morimoto et al. | 430/490 |
| 4,876,174 | A | | 10/1989 | Ishikawa et al. | 430/380 |
| 4,892,804 | A | | 1/1990 | Vincent et al. | 430/380 |
| 4,897,339 | A | * | 1/1990 | Andoh et al. | 430/490 |
| 4,985,347 | A | | 1/1991 | Fujimoto et al. | 430/393 |
| 5,071,734 | A | * | 12/1991 | Ueda et al. | 430/490 |
| 5,091,292 | A | | 2/1992 | Fujimoto et al. | 430/467 |
| 5,100,765 | A | | 3/1992 | Fujimoto | 430/434 |
| 5,250,396 | A | | 10/1993 | Ueda et al. | 430/357 |
| 5,344,750 | A | * | 9/1994 | Fujimoto et al. | 430/484 |
| 5,384,233 | A | * | 1/1995 | Kuse et al. | 430/489 |

FOREIGN PATENT DOCUMENTS

| | | |
|---|---|---|
| EP | 269227 | * 12/1992 |

* cited by examiner

*Primary Examiner*—Hoa Van Le
(74) *Attorney, Agent, or Firm*—J. Lanny Tucker

(57) ABSTRACT

Silver bromoiodide color negative films can be rapidly color developed using stabilized color developer solutions kept at high temperatures with minimal changes in the resulting color record densities. The compositions are stabilized by adjusting or maintaining the pH to 9 or more, but below 10.

14 Claims, No Drawings

HIGH TEMPERATURE COLOR DEVELOPMENT OF PHOTOGRAPHIC SILVER BROMOIODIDE COLOR NEGATIVE FILMS USING PH STABILIZED COLOR DEVELOPER

FIELD OF THE INVENTION

The present invention relates to stabilizing color developer solutions, and to the processing of silver bromoiodide color negative films. In particular, it relates to stabilizing color developer solutions having a pH of less than 10, where such solutions are held at high temperatures for extended periods of time.

BACKGROUND OF THE INVENTION

Production of photographic color images from light sensitive materials basically consists of two processes. First, color negative images are generated by light exposure of camera speed light sensitive films, which are sometimes called "originating" elements because the images are originated therein by the film user (that is, "picture taker"). These negative images are then used to generate positive images in light sensitive materials having a reflective base using a "printer". These latter materials are sometimes known as "display" elements and the resulting images may be known as "prints" or motion picture projection films.

The light sensitive materials are processed in several steps and processing solutions to provide the necessary images in automatic processing machines. Traditionally, this service has required one or two days for providing the customer with the desired prints. In recent years, customers have wanted faster service, and in some locations known as "mini-labs", it is desired to provide the customer with the desired prints within an hour. This requires the photoprocessing methods to be even faster, and reducing the processing time to within a few minutes is the ultimate desire in the industry.

Reduction in processing time of the "display" elements or color photographic papers has been facilitated by a number of recent innovations, including the use of predominantly silver chloride emulsions in the display elements.

Color negative films generally comprise little or no silver chloride in their emulsions, and generally have silver bromide as the predominant silver halide. More typically, the emulsions are silver bromoiodide emulsions with silver iodide levels up to several mol percent. Such films require these types of emulsions because emulsions containing high silver chloride have not demonstrated sufficient light sensitivity to be used as camera speed materials although they have the advantage of being rapidly processed without major changes to the color developer solution.

However, to shorten the processing time, specifically the color development time, of films containing silver bromoiodide emulsions, more active color developer solutions are needed. Various attempts have been made to increase color developer activity by increasing the pH, color developing agent concentration or temperature. However, when these changes are made, the stability of the solution often diminishes. For example, when the development temperature is increased from the conventional 37.8° C., and the color developer solution is held (or used) in the processing tanks for extended periods of times, silver bromoiodide elements processed with such solutions often exhibit unacceptably high density in the unexposed areas of the elements, that is unacceptably high Dmin.

Various methods have been proposed for stabilizing color developer solutions during use, but these methods are primarily used in processing high silver chloride emulsions. For example, color developers in U.S. Pat. No. 4,876,174 are stabilized for processing high silver chloride by containing dialkylhydroxylamine antioxidants or preservatives. Other preservatives are also described in the art, such as hydrazines, hydroxamic acid and alpha-hydroxyketones, as described for example in U.S. Pat. Nos. 4,897,339 and 4,906,554. Another method for stabilization is to use an anionic surface active agent in combination with a substituted alkylhydroxylamine to process high silver chloride elements having a dry thickness of less than 15 $\mu$m, as described in U.S. Pat. No. 5,091,292. Still another method involves using a processor having a small surface ratio of the color developer so it has less contact with air.

All of the foregoing methods have been designed for processing high silver chloride photographic papers, and have not been shown to be effective in processing color negative silver bromoiodide films.

Attempts have also been made to stabilize color developing solutions prior to their use, by storing them in sealed containers having low permeability to oxygen, as described in U.S. Pat. No. 4,814,260. Components that produce gases in the solutions are removed or replaced by non-gas producing components. Other storage containers have been designed from multilayers of various polymeric materials to reduce oxygen transmittance. However, these attempts fail to provide stability when the color developer solutions are being held for long periods of time at high temperature in the processing machine, especially when development is carried out at high temperature.

Copending and commonly assigned U.S. Ser. No. 08/590,241 filed Jan. 23, 1996, by Cole describes a method for high temperature color development of silver bromoiodide films wherein the color developing solution includes a certain hydroxylamine antioxidant. These antioxidants provide remarkable color developing solution stability, but there is a need for additional means for stabilizing the solution against an increase in Dmin during high temperature processing.

Thus, there remains a need for a process for rapid color development of silver bromoiodide films using color developer solutions stabilized for high temperature keeping.

SUMMARY OF THE INVENTION

The problems described above have been overcome with a method of photoprocessing comprising:

contacting an imagewise exposed color negative photographic film element containing at least one silver bromoiodide emulsion, with a color developer solution having a pH greater than about 9 but less than 10, and comprising:

a color developing agent present at from about 0.01 to about 0.1 mol/l, and an organic antioxidant present at from about 0.001 to about 0.5 mol/l, the antioxidant having the formula:

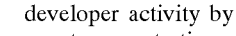

R—N(OH)—R' wherein R and R' are independently hydrogen, substituted or unsubstitued alkyl of 1 to 10 carbon atoms or substituted or unsubstituted aryl, the contacting being carried out at from about 50 to about 65° C. for from about 20 to about 150 seconds.

This invention also provides a method of stabilizing a color developer solution comprising:

a color developing agent present at from about 0.01 to about 0.1 mol/l, and an organic antioxidant present at from about 0.001 to about 0.5 mol/l, the antioxidant having the formula described above, the method comprising adjusting or maintaining the color developer solution pH at greater than about 9 but less than 10.

Moreover, this invention comprises a stabilized color developer solution having a pH greater than about 9 but less than 10, and comprising:

a color developing agent present at from about 0.01 to about 0.1 mol/l, and an organic antioxidant as described above that is present at from about 0.001 to about 0.5 mol/l.

The methods and color developer solution of this invention allow for rapid color development of camera ready film elements containing a silver bromoiodide emulsion. The color developer solutions are remarkably stable even when kept and used at relatively high temperatures, that is, above 50° C. for extended periods of time, for example, up to 144 hours at a temperature of 60° C. The color developer solutions have a pH greater than about 9 and less than 10 to provide the desired solution stability at high temperatures. Thus, solution stabilization can be provided for high temperature processing by adjusting and/or maintaining solution pH within this narrow range.

It has been unexpectedly found that the combination of photographic elements having silver bromoiodide emulsions and color developer solutions having these features minimizes the unacceptable increase in Dmin when the color developer solutions are kept and/or used at high processing temperatures for extended periods of time. For example, the Δ min in the three color records is less than 30% when such elements are processed for 45 seconds at 60° C. with the color developer solution of this invention that has been maintained or used at 6020 C. for up to 144 hours.

For purposes of this invention, "ΔDmin" is defined as:

$$\Delta Dmin = \frac{(1\%\ C_r + 1\%\ C_g + 1\%\ C_b)}{3}$$

wherein $$\%\ C_i = \left[\frac{Dmin_i(t) - Dmin_i(0)}{Dmin_i(0)}\right] \times 100$$

wherein i is r (red), g (green) or b (blue) for the respective color records, and "t" is time.

DETAILED DESCRIPTION OF THE INVENTION

The color developer solutions of this invention include as essential components one or more color developing agents and one or more organic antioxidants or preservatives for the color developing agents.

Useful organic antioxidants useful in the practice can be any hydroxylamine known in the art. Preferably, such compounds are represented by the formula I:

R—N(OH)—R' wherein R and R' are independently hydrogen, substituted or unsubstituted linear or branched alkyl of 1 to 10 carbon atoms (such as methylene, ethylene, n-propylene, isopropylene, n-butylene, 1,1-dimethylethylene, n-hexylene, n-octylene and sec-butylene), including substituted or unsubstituted, linear or branched alkylenephenylene groups having 1 to 3 carbon atoms in the alkylene portion (such as benzylene, dimethylenephenylene, and isopropylenephenylene), or substituted or unsubstituted aryl of 6 to 10 carbon atoms (such as phenylene and naphthylene), which can be substituted as described below for the alkyl groups.

The alkyl and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include but are not limited to, alkyl of 1 to 6 carbon atoms, fluoroalkyl groups of 1 to 6 carbon atoms, alkoxy of 1 to 6 carbon atoms, phenyl, carboxy, sulfo, sulfonamido, carbonamido, hydroxy, halo, phenoxy, alkylthio of 1 to 6 carbon atoms, acyl groups, cyano, phosphono or amino.

Preferably, at least one of R and R' is a substituted alkyl or alkylenephenylene group in which at least one substituent is hydroxy, alkoxy, sulfo, carboxy, phosphono, sulfonamido or carbonamido. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids.

When R or R' is alkylenephenylene, one substituent, such as carboxy, sulfo or phosphono, is preferably at the para position of the phenylene, but it can be at other positions if desired. More than one carboxy, sulfo or phosphono group can be attached to the phenylene radical.

More preferably, the substituents on R or R' are hydroxy, carboxy or sulfo (or salts or readily hydrolyzable esters of carboxy or sulfo).

In one embodiment, at least one of R and R' is a substituted or unsubstituted alkyl group of 3 to 6 carbon atoms that is branched at the carbon atom directly attached (that is, covalently bonded) to the nitrogen atom. Such branched divalent groups include, but are not limited to, isopropyl, sec-butyl, t-butyl, sec-pentyl, t-pentyl, sec-hexyl and t-hexyl among others that would be readily apparent to one skilled in the art. Isopropyl is most preferred.

Moreover, R and R' can be the same, forming "bis" molecules, and would thus be either unsubstituted, or have the same substituents.

Representative hydroxylamine derivatives useful in the practice of this invention include, but are not limited to, hydroxylamine (and equivalent salts), N,N-diethylhydroxylamine, N,N-dimethylhydroxylamine, N-ethyl-N-methylhydroxylamine, and N-p-methoxyphenyl-N-ethylhydroxylamine. More preferred antioxidants include N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N -(propionic acid)hydroxylamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl) hydroxylamine, N,N-bis(p-carboxylbenzyl)hydroxylamine, N-methyl-N-(p-carboxyl-m-methylbenzyl)hydroxylamine, N-isopropyl-N-(p-sulfobenzyl)hydroxylamine, N-ethyl-N-(p-phosphonobenzyl)hydroxylamine, N-isopropyl-N-(2-carboxymethylene-3-propionic acid)hydroxylamine, N-isopropyl-N-(methoxyethyl)hydroxylamine, N-methoxymethyl-N-(2-ethanesulfonic acid) hydroxylamine, N-isopropyl-N-(2-sulfonamidoethyl) hydroxylamine, N-isopropyl-N-(2-N-isopropylsulfonamidoethyl)hydroxylamine, N-isopropyl-N-(2-carbonamidoethyl)-hydroxylamine, N-isopropyl-N-(2-N',N'-dimethylcarbonamidoethyl)hydroxylamine, N-isopropyl-N-(2-(N'-isopropylcarbonamidoethyl) hydroxylamine, bis-2-(carbonamidoethyl)hydroxylamine, bis-3-(carbonamidopropyl)hydroxylamine, bis-2-N'-methylcarbonamidoethyl)hydroxylamine, bis-2-(N',N-dimethylcarbonamidoethyl)hydroxylamine and alkali metal salts thereof.

The hydroxylamine derivatives described herein as useful antioxidants can be readily prepared using published procedures, such as those described in U.S. Pat. Nos. 3,287,125, 3,778,464, 5,110,985 and 5,262,563, all incorporated herein by reference for the synthetic methods.

The organic antioxidant is included in the color developer solution of this invention in an amount of at least about 0.001 mol/l, and in a preferred amount of from about 0.001 to about 0.5 mol/l. A most preferred amount is from about 0.005 to about 0.5 mol/l. More than one organic antioxidant can be used if desired, but preferably, only one is used.

The pH of the color developer solution is maintained at least about 9 and less than 10, preferably from about 9 to about 9.7, and more preferably from about 9.3 to about 9.7, as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates. As used herein to define pH values, the term "about" refers to ±0.2 pH unit.

The color developer solutions of this invention include one or more color developing agents, of which there are hundreds of possibilities. Useful classes of such materials include, but are not limited to, aminophenols, p-phenylenediamines (especially N,N-dialkyl-p-phenylenediamines) and others that are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Generally, the amount of color developing agent is from about 0.01 to about 0.1 mol/l,, with from about 0.02 to about 0.06 mol/l, being preferred.

The color developer solution can be easily prepared by mixing a suitable color developing agent (in a suitable solution) with an organic antioxidant as described above (in a suitable aqueous solution). Water can be added to the resulting solution to provide the desired concentrations, and the pH can be adjusted and maintained in the desired range as noted above.

The solution can also include one or more of a variety of other addenda which are commonly used in such solutions, including alkali metal halides (such as potassium chloride, potassium bromide, sodium bromide and sodium iodide), metal sequestering agents (such as polycarboxylic or aminopolycarboxylic acids or polyphosphonates), other preservatives (such as sulfites, alcoholamines, amino acids and polysaccharides), antifoggants, development accelerators, optical brighteners, wetting agents, stain reducing agents, surfactants, defoaming agents, and water-soluble or water-dispersible color couplers, as would be readily understood by one skilled in the art (see for example, *Research Disclosure*, noted above and U.S. Pat. No. 4,814,260 of Koboshi et al). The amounts of such additives are well known in the art also. For example, the amounts of halides can be varied widely, but are generally at least about $5\times10^{-5}$ to about 0.4 mol/l, for bromide ion and at least about $5\times10^{-7}$ and up to about 0.01 mol/l for iodide ion. A preferred color developing solution is described below in the Example. It may or may not contain chloride ion because chloride ion essentially has no effect on the efficacy of the color developer composition. Thus, generally, chloride ion is not added or present, but if it is, it is not detrimental to the invention. It is more important that some bromide and iodide ions be present in the color developer solution.

The color developer solution is preferably formulated and used as an aqueous solution, either as the working developer solution or as a replenishing solution. However, as is known in the art, color developer compositions can also be formulated as dry tablets that are dropped into the processing tank to provide a color developing solution. The technology for this is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

The color developer solution has obvious utility to provide color development of an imagewise exposed color photographic negative image forming film element comprising a support and one or more silver halide emulsion layers (or color records) containing an imagewise distribution of developable silver halide emulsion grains. A wide variety of types of photographic films containing various types of emulsions can be processed using the present invention, the types of elements being well known in the art (see *Research Disclosure*, noted above). Generally, there are three color records in such color photographic films. The color developer solution can also be used in the processing of color reversal films having one or more color records.

The present invention is particularly useful for processing camera speed negative photographic films containing silver bromoiodide emulsions. Generally, the iodide content of such silver halide emulsions is less than about 40 mol % (based on total silver), preferably from about 0.05 to about 10 mol %, and more preferably, from about 0.5 to about 6 mol %. The emulsions can be of any crystal morphology (such as cubic, octahedral, cubooctahedral or tabular as are known in the art), or irregular morphology (such as multiple twinning or rounded). Preferably, the elements have at least two separate light sensitive emulsion layers, and each layer contains a silver bromoiodide emulsion as defined above.

Such elements generally have a camera speed defined as an ISO speed of at least 25, and preferably an ISO speed of at least 50.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27—1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The layers of the photographic elements can have any useful binder material or vehicle known in the art, including various types of gelatins and other colloidal materials (or mixtures thereof). One useful binder material is acid processed gelatin that can be present in any layer in any suitable amount.

The elements are typically exposed to suitable radiation to form a latent image and then processed to form a visible dye image. Processing includes the step of color development in the presence of a color developing agent (typically in a color developer) to reduce developable silver halide and to oxidize the color developing agent. Oxidized color developing agent in turn reacts with a color-forming coupler to yield a dye. Silver in the element can then be removed using conventional bleaching and fixing solutions.

Development is carried out by contacting the element under suitable time and temperature conditions, in suitable processing equipment, to produce the desired developed image. Additional processing steps can then be carried out using conventional procedures, including but not limited to, one or more development stop, bleaching, fixing, washing (or rinsing), stabilizing and drying steps, in any particular desired order as would be known in the art for either color negative or color reversal processing methods. Useful processing steps, conditions and materials useful therefor are well known (see for example, *Research Disclosure*).

The photographic elements processed in the practice of this invention can be single or multilayer color elements. Multilayer color elements typically contain dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerable details of the element structure and components, and suitable methods of processing various types of elements are described in *Research Disclosure,* noted above. Included within such teachings in the art is the use of various classes of cyan, yellow and magenta color couplers that can be used with the present invention. In particular, the present invention can be used to process photographic elements containing pyrazolotriazole magenta dye forming couplers.

Representative color negative films that can be processed using the present invention include, but are not limited to, KODAK ROYAL GOLD® films, KODAK GOLD® films, KODAK PRO GOLD™ films, KODAK FUNTIME™ films, KODAK EKTAPRESS Plus™ films, KODAK ADVANTIX™ films, FUJI SUPER G Plus films, FUJI SMART ™ film, FUJICOLOR NEXIA™ films, KONICA VX films, KONICA SRG3200 film, 3M SCOTCH® ATG films, and AGFA HDC and XRS films.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

The length of time and temperatures used for each processing step of the present invention, other than color development, can be any desired condition, whether conventional or not.

The color developer solution of this invention can be maintained at high temperatures for long periods of time without loss in developing activity. Thus, it is stabilized for such conditions. In most cases, the solutions are subjected to such temperatures during processing of the noted elements. For example, the color developing temperature is generally from about 50 to about 65° C., preferably from about 50 to about 60° C., and more preferably from about 55 to about 60° C.

The time for color development is from about 20 to about 150 seconds, with a time of from about 30 to about 120 seconds being preferred, and a time of from about 30 to about 90 seconds being more preferred. The overall processing time (from development to final rinse or wash) can be from about 50 seconds to about 15 minutes. Shorter overall processing times, that is, less than about 3 minutes, are desired for processing photographic color negative films according to this invention.

A preferred embodiment of this invention is a method of photoprocessing comprising:

A) contacting an imagewise exposed color negative photographic film element containing a red-sensitive emulsion layer, a green-sensitive emulsion layer and a blue-sensitive emulsion layer, each emulsion layer comprising a silver bromoiodide emulsion comprising from about 0.5 to about 10 mol % iodide based on total silver, with a color developer solution that has a pH of from about 9.0 to about 9.7, and comprises:

a color developing agent present at from about 0.01 to about 0.1 mol/l, and an antioxidant present at from about 0.001 to about 0.5 mol/l, the antioxidant having the formula I defined above wherein one of R and R' is a branched alkyl of 3 to 6 carbon atoms, the contacting being carried out at from about 55 to about 60° C. for from about 30 to about 90 seconds, B) bleaching the color developed element, C) fixing the bleached element, and D) stabilizing or rinsing the fixed element.

MATERIAL AND METHOD FOR THE EXAMPLE

The following example shows the magnitude of changes in the minimum (Dmin) density regions in each color record of samples of imagewise exposed, processed commercially available KODAK GOLD ULTRAT™ 400 speed color negative film as a function of the color developer age and pH. The film samples were developed at 60° C. for 45 seconds, and bleached, fixed and stabilized using conventional KODAK FLEXICOLOR C-41 RA™ conditions and solutions, and then dried.

The percent density changes for each color record (identified as "%Cr" for red record, "%Cg" for green record, and "%Cb" for blue record) were calculated as:

$$\% C_i = \left[\frac{Dmin_i(t) - Dmin_i(0)}{Dmin_i(0)}\right] \times 100$$

wherein Dmin(t) is the density at time "t" after the experiments have begun, and Dmin(0) is the density at the start of the experiments (time=0). By color records is meant the red-, green- and blue-sensitive units in the film samples, each unit having one or more emulsion layers having the desired light sensitivity.

EXAMPLE

The color developer solutions of this invention were formulated as shown in Table I, with pH adjusted to 9.0, 9.5 and 9.7 by adding sodium borate.10 $H_2O$ and adjusting with NaOH or $H_2SO_4$. The processing results are shown in Tables III, IV and V, respectively, for the various pH levels.

TABLE I

| Component | Amount |
|---|---|
| Water | 800 ml |
| Sodium Borate, 10-hydrate | 28.6 grams |
| Potassium carbonate, anhydrous | 18.6 grams |
| Potassium bicarbonate | 2.32 grams |
| Sodium Sulfite, anhydrous | 0.38 grams |
| Sodium metabisulfite | 2.78 grams |
| Potassium iodide | 1.20 milligrams |
| Diethylenetriaminepentaacetic acid pentasodium salt (40% solution) | 8.43 grams |
| Hydroxylamine sulfate | 2.41 grams |
| Sodium bromide | 5.0 grams |
| 4-Amino-3-methyl-N-ethyl-N-hydroxyethyl aniline | 8.0 grams |
| Water to make | 1.0 liter |

A color developer solution outside this invention was formulated as shown in Table II, and its pH was adjusted to 10. The results from processing are shown in Table VI below.

TABLE II

| Component | Amount |
|---|---|
| Water | 800 ml |
| Potassium carbonate, anhydrous | 34.3 grams |
| Potassium bicarbonate | 2.32 grams |
| Sodium Sulfite, anhydrous | 0.38 grams |
| Sodium metabisulfite | 2.78 grams |
| Potassium iodide | 1.20 milligrams |
| Diethylenetriaminepentaacetic acid pentasodium salt (40% solution) | 8.43 grams |
| Hydroxylamine sulfate | 2.41 grams |
| Sodium bromide | 5.0 grams |
| 4-Amino-3-methyl-N-ethyl-N-hydroxyethyl aniline | 8.0 grams |
| Water to make | 1.0 liter |

TABLE III (pH = 9.0)

| Time (Hours) | Dmin Red Record | Dmin Green Record | Dmin Blue Record | % Cr | % Cg | % Cb |
|---|---|---|---|---|---|---|
| 0 | 0.278 | 0.747 | 1.027 | 0 | 0 | 0 |
| 72 | 0.288 | 0.756 | 1.041 | 4 | 1 | 1 |
| 144 | 0.306 | 0.775 | 1.081 | 10 | 4 | 5 |
| 240 | 0.354 | 0.825 | 1.163 | 27 | 10 | 13 |
| 312 | 0.365 | 0.841 | 1.211 | 31 | 13 | 18 |

TABLE IV (pH = 9.5)

| Time (Hours) | Dmin Red Record | Dmin Green Record | Dmin Blue Record | % Cr | % Cg | % Cb |
|---|---|---|---|---|---|---|
| 0 | 0.313 | 0.758 | 1.001 | 0 | 0 | 0 |
| 96 | 0.332 | 0.782 | 1.032 | 6 | 3 | 3 |
| 144 | 0.364 | 0.832 | 1.082 | 16 | 10 | 8 |
| 168 | 0.390 | 0.860 | 1.114 | 24 | 13 | 11 |
| 264 | 0.446 | 0.898 | 1.179 | 42 | 18 | 18 |

TABLE V (pH = 9.7)

| Time (Hours) | Dmin Red Record | Dmin Green Record | Dmin Blue Record | % Cr | % Cg | % Cb |
|---|---|---|---|---|---|---|
| 0 | 0.324 | 0.786 | 1.021 | 0 | 0 | 0 |
| 96 | 0.342 | 0.816 | 1.060 | 6 | 4 | 4 |
| 144 | 0.361 | 0.835 | 1.075 | 11 | 6 | 5 |
| 168 | 0.380 | 0.860 | 1.107 | 17 | 9 | 8 |
| 264 | 0.444 | 0.915 | 1.172 | 37 | 16 | 15 |

TABLE VI (pH = 10)

| Time (Hours) | Dmin Red Record | Dmin Green Record | Dmin Blue Record | % Cr | % Cg | % Cb |
|---|---|---|---|---|---|---|
| 0 | 0.336 | 0.831 | 1.056 | 0 | 0 | 0 |
| 96 | 0.496 | 0.999 | 1.174 | 28 | 20 | 11 |
| 144 | 0.505 | 1126 | 1.250 | 50 | 36 | 18 |
| 168 | 0.565 | 1.247 | 1.330 | 68 | 50 | 26 |
| 264 | 0.656 | 1.390 | 1.458 | 95 | 67 | 38 |

It is obvious from the results shown in Tables III–VI that by adjusting the pH of the color developer solution to 9.0 or above but below 10.0, a significant increase in solution stability can be achieved when it is held and/or used at elevated temperatures (e.g., 60° C.) for long periods of time.

The invention has been described in detail with particular reference to preferred embodiments thereof, but it will be understood that variations and modifications can be effected within the spirit and scope of the invention.

I claim:

1. A method of photoprocessing comprising:

contacting an imagewise exposed color negative photographic film element containing at least one silver bromoiodide emulsion, with a color developer solution having a pH of from about 9.0 to 9.7, and comprising:

a color developing agent present at from about 0.02 to about 0.1 mol/l, bromide ions at from about $5\times10^{-5}$ to about 0.4 mol/l, iodide ions at from about $5\times10^{-7}$ to about 0.01 mol/l, borate buffer sufficient to maintain said pH, and an organic antioxidant present at from about 0.005 to about 0.5 mol/l, said antioxidant having the formula:

R—N(OH)—R' wherein R and R' are independently hydrogen, substituted or unsubstituted alkyl of 1 to 10 carbon atoms or substituted or unsubstituted aryl, said contacting being carried out at from about 55 to about 65° C. for from about 20 to about 150 seconds, wherein said photographic film element exhibits a $\Delta D_{min}$ of less than 30% when it is processed with said color developer solution for 45 seconds at 60° C., provided said color developer solution has been maintained or used at 60° C. for up to 144 hours.

2. The method of claim 1 wherein said silver bromoiodide emulsion comprises less than about 40 mol % iodide based on total silver.

3. The method of claim 1 wherein said photographic film element comprises at least three separate light sensitive color records, and each color record comprises a silver bromoiodide emulsion.

4. The method of claim 1 wherein said contacting is carried out at for from about 30 to about 120 seconds.

5. The method of claim 4 wherein said contacting is carried out at for from about 30 to about 90 seconds.

6. The method of claim 1 wherein said organic antioxidant is present in an amount of from about 0.005 to about 0.5 mol/l, and wherein R and R' are independently substituted or unsubstituted alkyl of 3 to 6 carbon atoms, or substituted or unsubstituted alkylenephenylene having 1 to 3 carbon atoms in the alkylene portion.

7. The method of claim 1 wherein R and R' are the same.

8. The method of claim 1 wherein at least one of R and R' is an alkyl of 3 to 6 carbon atoms that is branched at the carbon atom directly attached to the nitrogen atom.

9. The method of claim 1 wherein R and R' are independently alkyl substituted with at least one hydroxy, carboxy or sulfo group.

10. The method of claim 1 wherein R and R' are independently alkyl substituted with at least one hydroxy, carboxy, sulfo, sulfonamido, carbonamido or phosphono group.

11. The method of claim 1 wherein said antioxidant is N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl-N-(2-ethanesulfonic acid)hydroxylamine, N,N -bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl) hydroxylamine, N-methyl-N-(p-carboxyl-m-methylbenzyl) hydroxylamine, N-isopropyl-N-(p-sulfobenzyl) hydroxylamine, N-ethyl-N-(p-phosphonobenzyl) hydroxylamine, N-isopropyl-N-(2-carboxymethylene-3-propionic acid)hydroxylamine, N-isopropyl-N-(methoxyethyl)hydroxylamine, N-methoxymethyl-N-(2-ethanesulfonic acid)hydroxylamine, N-isopropyl-N-(2-sulfonamidoethyl)hydroxylamine, N-isopropyl-N-(2-N-isopropylsulfonamidoethyl)hydroxylamine, N-isopropyl-N-(2-carbonamidoethyl)hydroxylamine, N-isopropyl-N-(2-N', N'-dimethylcarbonamidoethyl)hydroxylamine, N-isopropyl-N-2-(N'-isopropylcarbonamidoethyl)-hydroxylamine, bis-2-(carbonamidoethyl)hydroxylamine, bis-3-(carbonamidopropyl)hydroxylamine, bis-2-N'-methylcarbonamidoethyl)hydroxylamine, bis-2-(N', N-dimethylcarbonamidoethyl)hydroxylamine or an alkali metal salt thereof.

12. The method of claim 1 wherein said color developer solution has a pH of from about 9.3 to 9.7.

13. A method of photoprocessing comprising:

A) contacting an imagewise exposed color negative photographic film element containing a red-sensitive emulsion layer, a green-sensitive emulsion layer and a blue-sensitive emulsion layer, each emulsion layer comprising a silver bromoiodide emulsion comprising from about 0.5 to about 10 mol % iodide based on total silver, with a color developer solution having a pH of from about 9.3 to about 9.7, and comprising:

a color developing agent present at from about 0.01 to about 0.1 mol/l, bromide ions at from about $5\times10^{-5}$ to about 0.4 mol/l, iodide ions at from about $5\times10^{-7}$ to about 0.01 mol/l, borate buffer sufficient to maintain said pH, and an antioxidant present at from about 0.001 to about 0.5 mol/l, said antioxidant having the formula:

R—N(OH)—R' wherein R and R' are independently hydrogen or substituted or unsubstituted branched alkyl of 3 to 6 carbon atoms, said contacting being carried out at from about 55 to about 60° C. for from about 30 to about 90 seconds, B) bleaching said color developed element, C) fixing said bleached element, and D) stabilizing or rinsing said fixed element, wherein said photographic film element exhibits a $\Delta D_{min}$ of less than 30% when it is processed with said color developer solution for 45 seconds at 60° C., provided said color developer solution has been maintained or used at 60° C. for up to 144 hours.

14. A stabilized color developer solution having a pH greater than about 9.3 but less than 9.7, and comprising:

a color developing agent present at from about 0.02 to about 0.1 mol/l, bromide ions at from about $5\times10^{-5}$ to about 0.4 mol/l, iodide ions at from about $5\times10^{-7}$ to about 0.01 mol/l, borate buffer sufficient to maintain said pH, and an organic antioxidant present at from about 0.005 to about 0. 5 mol/l, said antioxidant having the formula:

R—N(OH)—R' wherein R and R' are independently hydrogen, substituted or unsubstituted alkyl of 1 to 10 carbon atoms or substituted or unsubstituted aryl.

* * * * *